US009683732B2

(12) United States Patent
Wepfer et al.

(10) Patent No.: US 9,683,732 B2
(45) Date of Patent: Jun. 20, 2017

(54) ANTI-CLOGGING STEAM GENERATOR TUBE BUNDLE

(75) Inventors: Robert M. Wepfer, Export, PA (US); James R. Schwall, Chattanooga, TN (US); Christopher A. Weindorf, Pittsburgh, PA (US); John R. Balavage, North Huntingdon, PA (US)

(73) Assignee: Westinghouse Electric Company, Cranberry Township, PA (US)

( * ) Notice: Subject to any disclaimer, the term of this patent is extended or adjusted under 35 U.S.C. 154(b) by 1604 days.

(21) Appl. No.: 13/272,524

(22) Filed: Oct. 13, 2011

(65) Prior Publication Data

US 2013/0092106 A1 Apr. 18, 2013

(51) Int. Cl.

| | |
|---|---|
| ***F22B 23/06*** | (2006.01) |
| ***F22B 1/02*** | (2006.01) |
| ***F22B 37/20*** | (2006.01) |
| ***F28F 9/013*** | (2006.01) |
| ***F28F 19/00*** | (2006.01) |
| ***F28D 7/06*** | (2006.01) |

(52) U.S. Cl.

CPC ..... *F22B 1/025* (2013.01); *F22B 37/205* (2013.01); *F28D 7/06* (2013.01); *F28F 9/0131* (2013.01); *F28F 19/00* (2013.01)

(58) Field of Classification Search

CPC ..... F22B 1/025; F22B 37/205

USPC ..... 122/367.1, 512; 165/162, 178, 161, 165/DIG. 432, DIG. 433; 248/56

See application file for complete search history.

(56) References Cited

U.S. PATENT DOCUMENTS

| | | | | |
|---|---|---|---|---|
| 4,120,350 | A | 10/1978 | Norton | |
| 4,318,368 | A | 3/1982 | Carson et al. | |
| 4,357,908 | A | 11/1982 | Yazidjian | |
| 4,699,665 | A | 10/1987 | Scharton | |
| 4,709,756 | A | 12/1987 | Wilson et al. | |
| 4,736,713 | A | 4/1988 | Roarty | |
| 4,756,770 | A | 7/1988 | Weems | |
| 4,921,662 | A | 5/1990 | Franklin | |
| 6,059,022 | A * | 5/2000 | Wilson | 165/162 |
| 6,189,212 | B1 * | 2/2001 | Hawkins et al. | 29/890.031 |
| 6,302,064 | B1 * | 10/2001 | Billoue et al. | 122/491 |
| 8,342,474 | B2 * | 1/2013 | Gilbreath | 248/558 |
| 2007/0181082 | A1 * | 8/2007 | Barkich | 122/459 |
| 2010/0276550 | A1 | 11/2010 | Klarner et al. | |

FOREIGN PATENT DOCUMENTS

DE 2243402 A1 4/1974

OTHER PUBLICATIONS

International Preliminary Report on Patentability for PCT/US2012/052959 dated Apr. 24, 2014 (Forms PCT/IB/373, PCT/ISA/237).

Westinghouse Electric Company LLC, EP 12841305.1 Search Report, Oct. 14, 2015, 6 pages.

* cited by examiner

*Primary Examiner* — Steven B McAllister
*Assistant Examiner* — Ko-Wei Lin
(74) *Attorney, Agent, or Firm* — Eckert Seamans Cherin & Mellott, LLC; Daniel C. Abeles

(57) ABSTRACT

A tube and shell steam generator having an anti-clogging heat exchange tube bundle wherein the tube support plates within the tube bundle are designed with varying degrees of porosity thereby regulating local secondary side fluid conditions (velocity, quality, superheat, void fraction, etc.) in a manner to reduce the potential for clogging of the tube support plate lobes that are more prone to clogging.

14 Claims, 8 Drawing Sheets

ANTI-CLOGGING STEAM GENERATOR TUBE BUNDLE

BACKGROUND

1. Field

This invention relates generally to tube support arrangements for steam generators and more particularly to a tube support arrangement for a tube and shell steam generator that minimizes clogging of the recirculation flow holes in the tube support plates among the outside of the heat exchanger tubes.

2. Description of Related Art

A pressurized water nuclear reactor steam generator typically comprises a vertically oriented shell, a plurality of U-shaped tubes disposed in the shell so as to form a tube bundle, a tube sheet for supporting the tubes at the ends opposite the U-like curvature, a divider plate that cooperates with the tube sheet and a channel head forming a primary fluid inlet header at one end of the tube bundle and a primary fluid outlet header at the other end of the tube bundle. A primary fluid inlet nozzle is in fluid communication with the primary fluid inlet header and a primary fluid outlet nozzle is in fluid communication with the primary fluid outlet header. The steam generator secondary side comprises a wrapper disposed between the tube bundle and the shell to form an annular chamber made up of the shell on the outside and the wrapper on the inside, and a feedwater ring disposed above the U-like curvature end of the tube bundle.

The primary fluid having been heated by circulation through the reactor enters the steam generator through the primary fluid inlet nozzle. From the primary fluid inlet nozzle, the primary fluid is conducted through the primary fluid inlet header, through the U-tube bundle, out the primary fluid outlet header and through the primary fluid outlet nozzle to the remainder of the reactor coolant system. At the same time, feedwater is introduced into the steam generator secondary side, i.e., the side of the steam generator interfacing with the outside of the tube bundle above the tube sheet, through a feedwater nozzle which is connected to a feedwater ring inside the steam generator. In one embodiment, upon entering the steam generator, the feedwater mixes with water returning from moisture separators. This mixture, called the downcomer flow, is conducted down the annular chamber adjacent the shell until the tube sheet located at the bottom of the annular chamber causes the water to change direction, passing in heat transfer relationship with the outside of the U-tubes and up through the inside of the wrapper. While the water is circulating in heat transfer relationship with the tube bundle, heat is transferred from the primary fluid in the tubes to water surrounding the tubes causing a portion of the water surrounding the tubes to be converted to steam. To differentiate this steam/water mixture from the single phase downcomer flow, this mixture is designated as the tube bundle flow. The steam then rises and is conducted through a number of moisture separators that separate entrained water from the steam, and the steam vapor then exits the steam generator and is typically circulated through a turbine to generate electricity in a manner well known in the art.

Since the primary fluid contains radioactive materials and is isolated from the feedwater only by the U-tube walls, the U-tube walls form part of the primary boundary for isolating these radioactive materials. It is, therefore, important that the U-tubes be maintained defect free by being well supported so that no breaks will occur in the U-tubes that will cause radioactive materials from the primary fluid to enter the secondary side, which would be an undesirable result. Support for the U-tubes is mainly accomplished by a plurality of transverse, spaced, tandem tube support plates that are positioned axially along the height of the tube bundle and through which the heat exchanger tubes pass with their ends extending through and being affixed to the tube sheet. The holes in the support plates typically have lands that laterally support the heat exchange tubes and lobes between the lands that permit the passage of the tube bundle flow and steam. However, tube support plate fouling or clogging has been reported in various steam generators over approximately the past twenty years and has been an increasing issue, particularly in plants with low pH and high levels of solid ingress to the steam generators. Tube support plate fouling leads to water level instability, which must be addressed in the short term by power level reductions, until chemical cleaning of the steam generators can be performed. It has been noted that fouling occurs in the upper portions of the tube bundle, where pressure drops and velocities are higher and densities lower. Plant operators have expressed interest in tube support plate designs which reduce the potential for fouling and avoid the necessity for reducing power levels.

Accordingly, a new support plate design and system of support plates is desired that will reduce or eliminate the deposition of crud and precipitates in the tube bundle fluid passageways to enhance the continued efficiency of the steam generator in transferring heat from the primary side to the secondary side.

It is a further object of the embodiments described herein to provide such an improvement that will not reduce the power level of such a steam generator.

SUMMARY

These and other objects are achieved by the embodiments described herein which provide a tube and shell steam generator having an elongated shell with an axis extending along its elongated dimension and a tube sheet within the shell supported substantially transverse to the axis. A plurality of heat exchange tubes extend axially from the tube sheet, within the shell, with the plurality of heat exchange tubes forming a tube bundle. The tube bundle has a plurality of tandemly spaced tube support plates respectively positioned substantially transverse to the axis and extending substantially over a width of the tube bundle. The tube support plates are designed to pass a fluid through the tube support plates with a flow of the fluid regulated so the flow is larger through some portions of the tube support plates than other portions of the tube support plates. Preferably, the flow of the fluid through the tube support plates is regulated by varying the geometry of the holes in the tube support plates. Desirably, some of the holes through which the heat exchange tubes extend are larger than others of the holes through which the heat exchange holes extend. In one embodiment, at least one of an upper most tube support plate has holes around a periphery through which the heat exchange tube extends that are smaller than the holes through which the heat exchange tubes extend towards the center of the upper most tube support plate; and, preferably, the upper most tube support plate comprises a plurality of upper most tube support plates. In another embodiment, the holes through which the heat exchange tubes pass have a plurality of lobes on a periphery of the holes, and the larger holes have a larger radius that extends from the center line of the holes to the lobe.

Typically, the heat exchanger tubes have a cold leg and a hot leg, and at least some of the holes in at least some of the tube support plates through which the hot legs pass are smaller than at least some of the holes through which the cold legs pass. Preferably, the steam generator has a plurality of upper tube support plates and a plurality of lower tube support plates and at least some of the holes in at least some of the lower tube support plates through which the hot legs pass are smaller than at least some of the holes in at least some of the upper tube support plates. In still another embodiment, some of the holes in at least some of the lower support plates through which the hot legs pass are smaller than at least some of the holes through which at least some of the cold legs pass. Desirably, some of the holes in at least some of the lower support plates through which the hot legs pass are smaller than substantially all of the holes through which the cold legs pass.

In yet another embodiment, the steam generator includes U-shaped heat exchange tubes having a cold leg and a hot leg with the flow of fluid regulated by varying tube support plate porosity so that the flow of fluid through most of the sides of the tube support plates through which the cold legs pass is larger than the flow of fluid through most of the sides of the tube support plates through which the hot legs pass. By larger it is meant that the fluid conditions, e.g., one or more of the velocity, quality, subcooling, etc, are altered versus designs that have substantially constant porosity across a tube sheet span at any given elevation. Preferably, the steam generator has a plurality of upper tube support plates and a plurality of lower tube support plates, and the tube support plate porosity through a periphery of the upper tube support plates is less than the tube support plate porosity through a central portion of the same upper tube support plates. Typically, the U-shaped heat exchange tubes have a cold leg and a hot leg wherein the tube support plate porosity through the periphery of the upper tube support plates is less than the tube support plate porosity through the central portion on a hot leg side of the upper support plates. In still another embodiment, the tube support plate porosity is at least partially regulated by a series of slots or holes in a central tube lane in at least some of the tube support plates.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
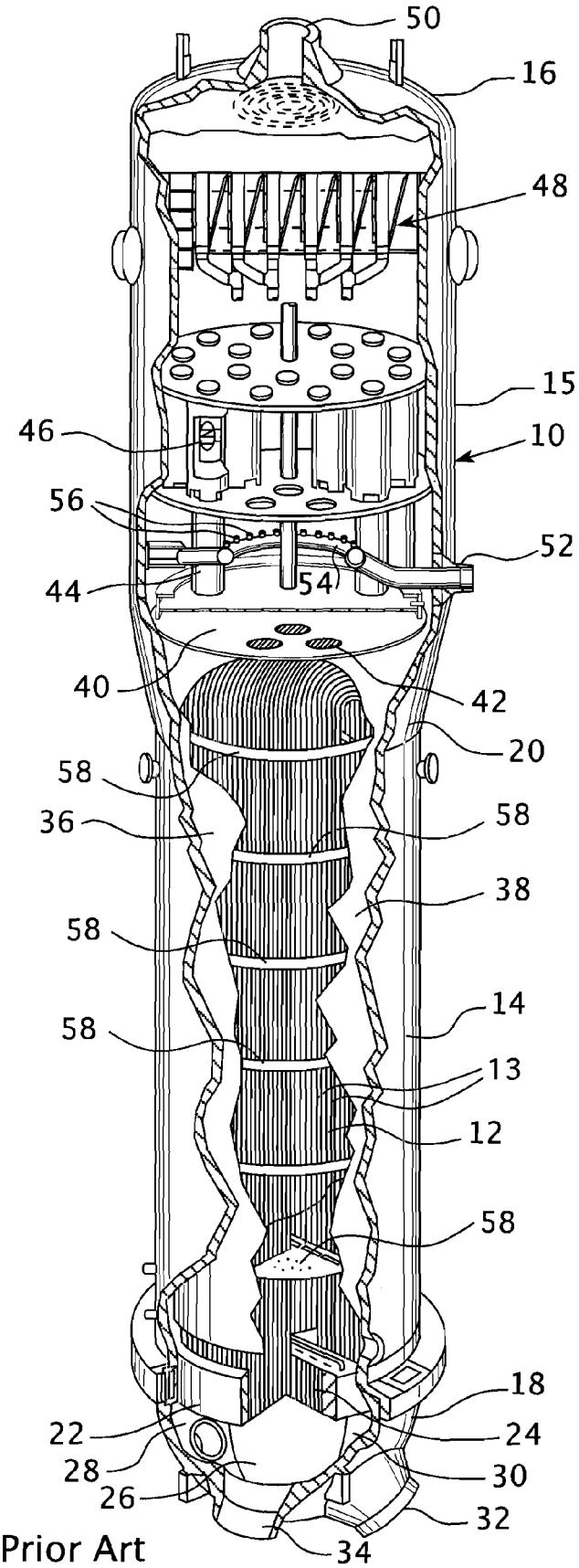
FIG. 1 Prior Art
FIG. 1 is a perspective view, partially cut away, of a prior art vertical tube and shell steam generator.

Referring now to the drawings, FIG. 1 shows a steam or vapor generator 10 that utilizes a plurality of U-shaped tubes which form a tube bundle 12 to provide the heating surface required to transfer heat from a primary fluid to vaporize or boil a secondary fluid. The steam generator 10 comprises a vessel having a vertically oriented tubular shell portion 14 and a top enclosure or dished head 16 enclosing the upper end and a generally hemispherical shaped channel head 18 enclosing the lower end. The lower shell portion 14 is smaller in diameter than the upper shell portion 15, and a frustoconical shaped transition 20 connects the upper and lower portions. A tube sheet 22 is attached to the channel head 18 and has a plurality of holes 24 disposed therein to receive ends of the U-shaped tubes 13. A divider plate 26 is centrally disposed within the channel head 18 to divide the channel head into two compartments 28 and 30, which serve as headers for the tube bundle 12. Compartment 30 is the primary fluid inlet compartment and has a primary fluid inlet nozzle 32 in fluid communication therewith. Compartment 28 is the primary fluid outlet compartment and has a primary fluid outlet nozzle 34 in fluid communication therewith. Thus, primary fluid, i.e., the reactor coolant which enters fluid compartment 30, is caused to flow through the tube bundle 12 and out through outlet nozzle 34.

The tube bundle 12 is encircled by a wrapper 36 which forms an annular passage 38 between the wrapper 36 and the shell and cone portions 14 and 20, respectively. The top of the wrapper 36 is covered by a lower deck plate 40 which includes a plurality of openings 42 in fluid communication with a plurality of larger tubes 44. Swirl vanes 46 are disposed within the larger tubes 44 to cause steam flowing therethrough to spin and centrifugally remove some of the moisture contained within the steam as it flows through this primary centrifugal separator. The water separated from the steam in this primary separator is returned to the top surface of the lower deck plate 40. After flowing through the centrifugal separator, the steam passes through a secondary separator 48 before reaching a steam outlet nozzle 50 centrally disposed in the dish head 16.

The feedwater inlet structure of this generator includes a feedwater inlet nozzle 52 having a generally horizontal portion called a feedring 54 and a plurality of discharge nozzles 56 elevated above the feedring. Feedwater, which is supplied through the feedwater inlet nozzle 52, passes through the feedwater ring 54 and exits through discharge nozzles 56 and, in one prior art embodiment, mixes with water which was separated from the steam and is being recirculated. The mixture then flows down from above the lower deck plate 40 into the annular, downcomer passage 38. The water then enters the tube bundle 12 at the lower portion of the wrapper 36 and flows among and up the tube bundle where it is heated to generate steam.

The boiling action of the water and the flow of fluids past the heat exchange tubes can cause fluidelastic excitation or turbulence excitation that can result in vibrations of the heat exchange tubes which can accelerate their wear. A plurality of tandemly spaced heat exchange tube support plates 58 are positioned transverse to the axial dimension of the shell 14 and have holes through which the heat exchange tubes extend. The holes are specifically designed to both support the heat exchange tubes and provide openings for the feedwater and recirculation flow and steam to pass therethrough.

Figure 2:
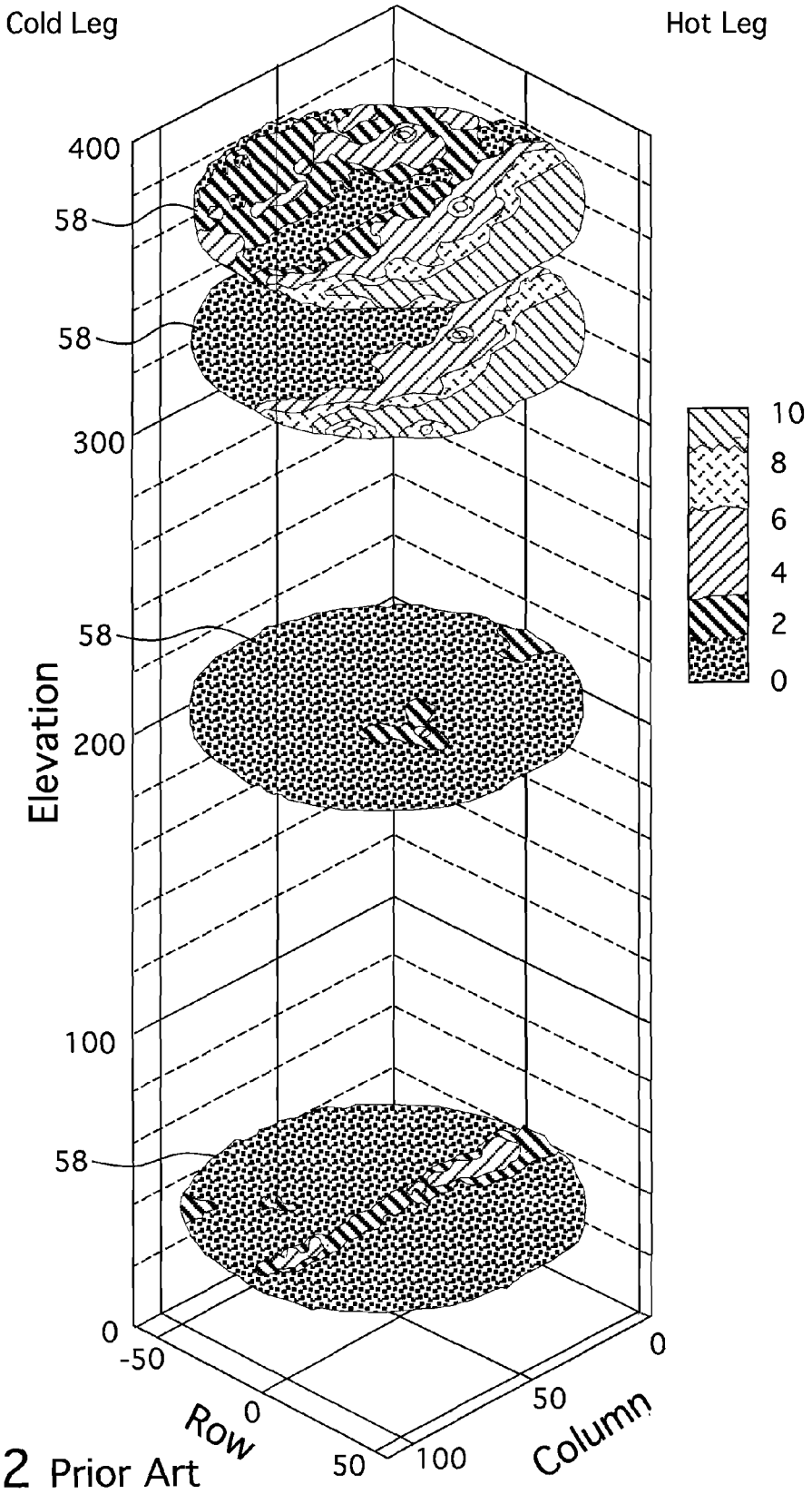
FIG. 2 Prior Art
FIG. 2 is an isometric graphical representation of the tube support plate flow blockage (clogging) distribution in the tube bundle area of a prior art tube and shell steam generator.

As previously mentioned, tube support plate fouling or clogging has been reported in various steam generators over approximately the past twenty years. Tube support plate fouling can lead to water level instability which needs to be avoided. It has been observed that fouling occurs in the upper portions of the tube bundle where pressure drops and velocities are higher and densities lower. This can be observed in the graphical representation of a number of the plurality of tube support plates shown in FIG. 2, with the degree of blockage shown in the legend. The lower two support plates 58 shown in FIG. 2 represent the first and fifth tube support plates, counting from the tubesheet secondary surface, while the upper two support plates 58 represent the eighth and ninth tube support plates. Clogging can readily be observed on tube support plates 8 and 9 by reference to the legend. It can also be observed that the fouling primarily occurs on the one side of the support plates through which the hot legs of the U-tube steam generator heat exchange tubes pass. The hot legs are the sides of the U-tubes that are closest to the primary inlet plenum of the generator. Not only is the fouling substantially limited to the upper support plates, but it also preferentially occurs on the periphery of the hot leg sides of those support plates. The fouling is a result of a deposit of oxides present in the secondary side water, resulting in partial or total blockage of the affected lobes of the tube support plates that support the heat exchange tubes. In contrast, as can be seen from the representation of tube support plates 1 and 5, shown in FIG. 2, there is very little deposit of oxides on the lower tube support plates. Fouling typically preferentially occurs towards the bottom of the tube support plates, where recirculating water enters the lobes of the heat exchange tubes' support holes.

Figure 3:
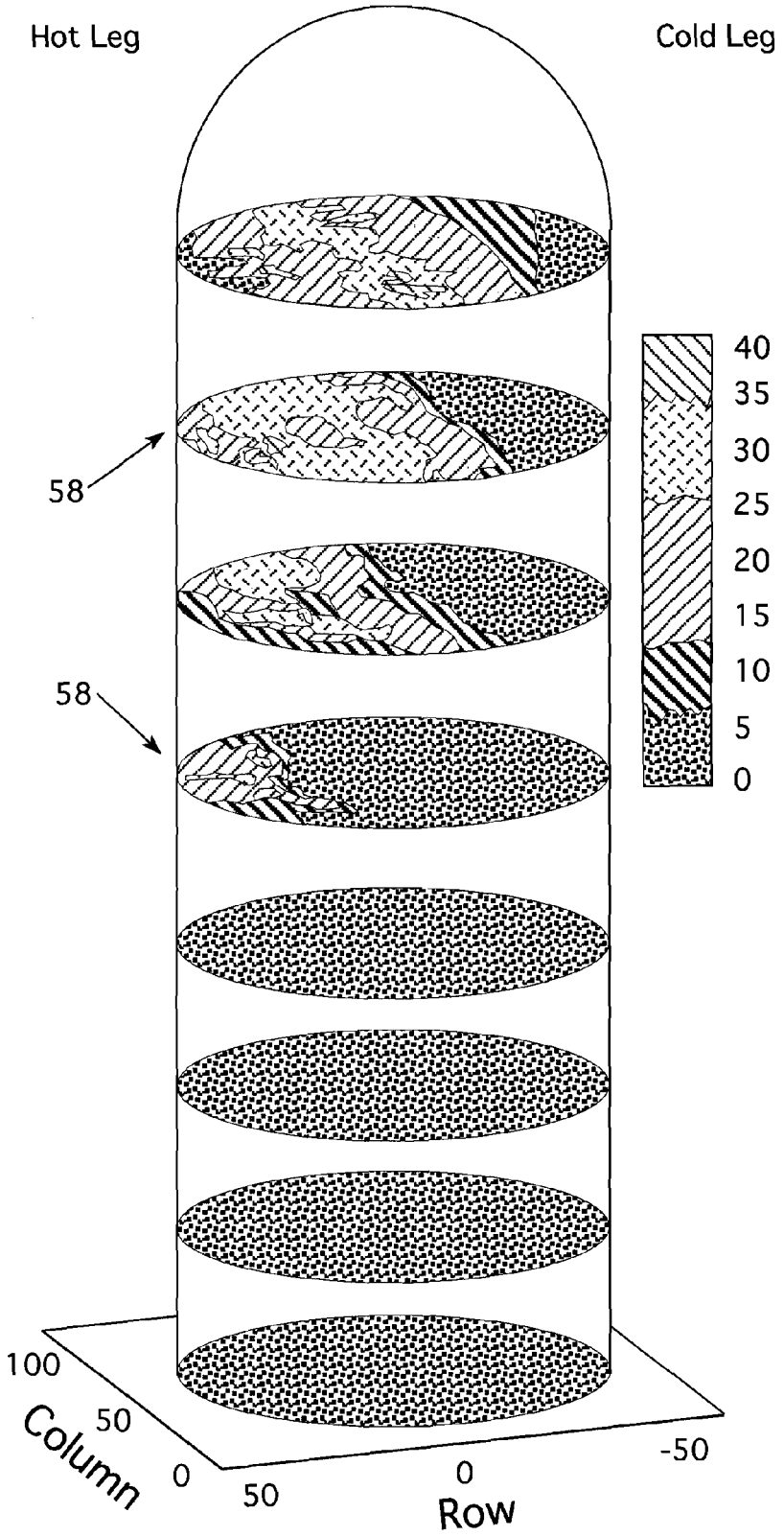
FIG. 3 Prior Art
FIG. 3 is an isometric graphical representation of the deposit pattern along the tube support plates of a prior art tube and shell steam generator.

FIG. 3 illustrates a typical deposit pattern that may occur on the heat exchange tubing during operation of the steam generators. While different than tube support plate fouling, this figure in this example illustrates that deposits can typically initiate at the periphery of the tube bundle near the edges of the fourth tube support plate and increase in the tube spans to the fifth, sixth and seventh tube support plates (it should be noted that the bottom plate is the flow distribution baffle that is not counted among the tube support plates).

Figure 4:
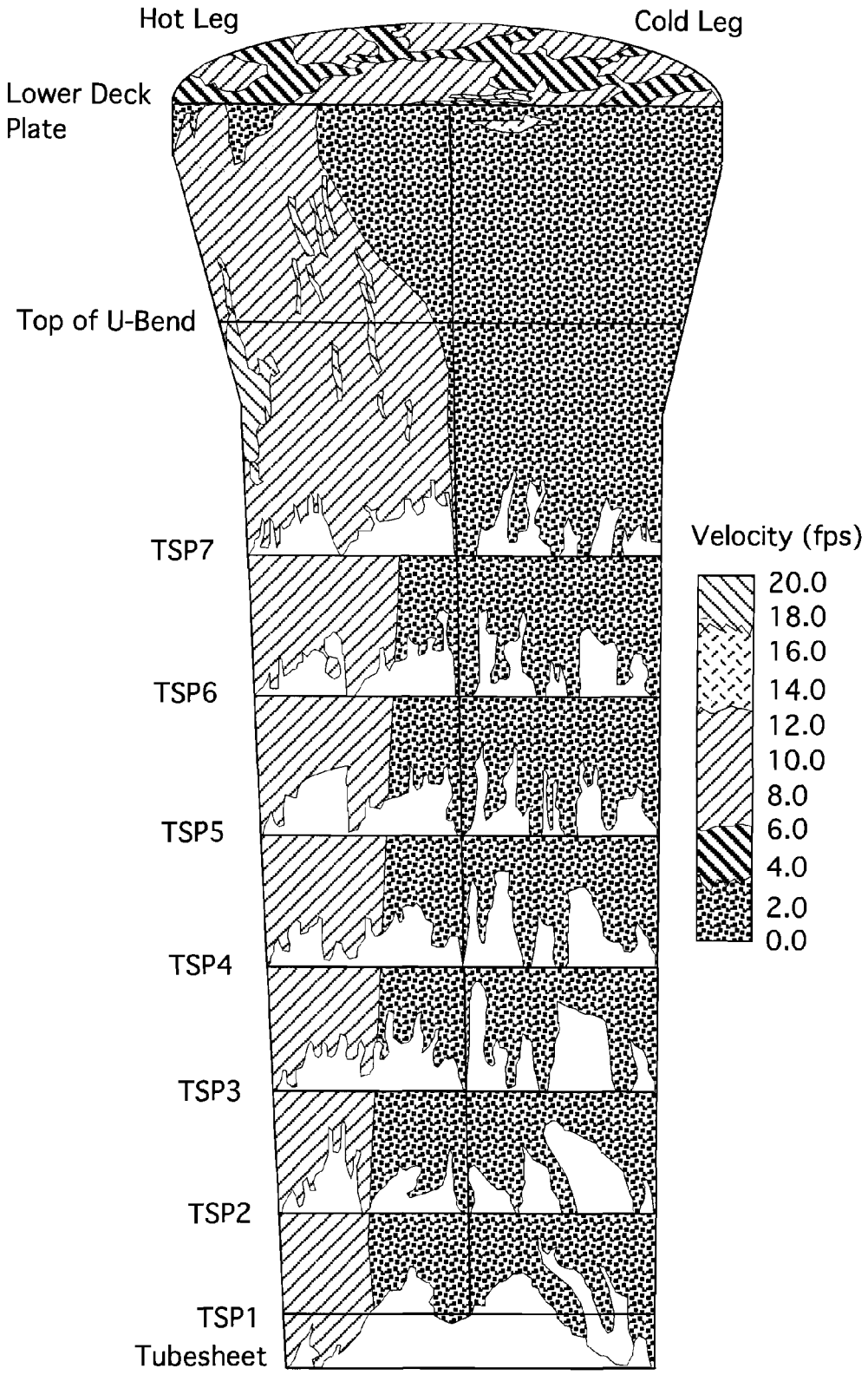
FIG. 4 Prior Art
FIG. 4 is a schematic representation of the two-phase flow velocity distribution within the vicinity of the tube bundle of a prior art tube and shell steam generator.

FIG. 4 shows the two-phase flow velocity distributions calculated for a typical tube and shell steam generator. Higher velocities are noted on the hot leg side at the periphery of the upper most support plates. Tube support plate fouling on the hot leg side appears to be reasonably correlated to the regions of higher velocity, and hence higher pressure drop.

Figure 5:
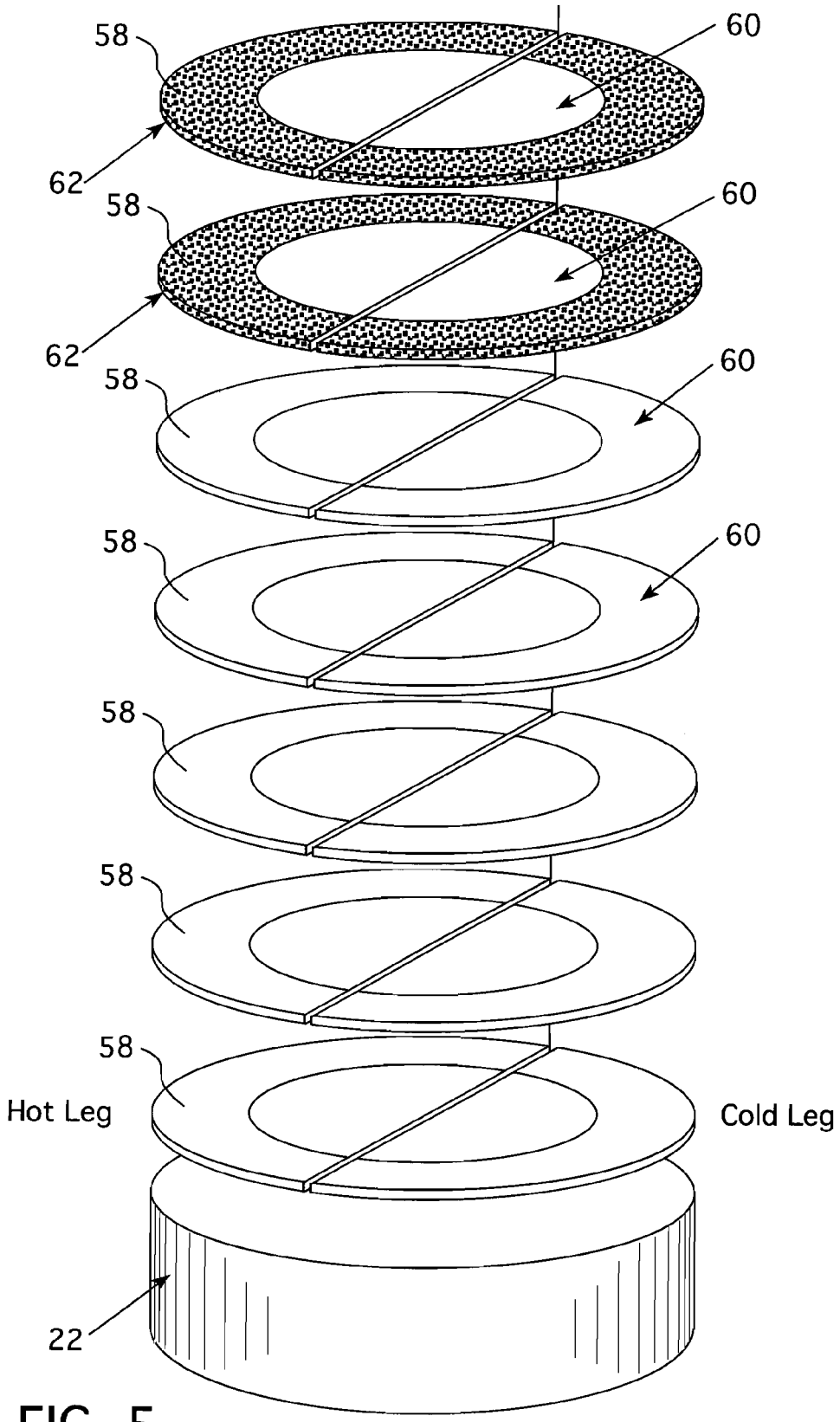
FIG. 5 is a schematic representation of the relative hole pattern employed in the heat exchange tube support plates of a tube and shell steam generator in accordance with one embodiment of the invention described herein.

The embodiments described hereinafter regulate the flow of the recirculation fluid and feedwater through the tube support plates to control the velocity of the flow across the areas of the tube support plates that have exhibited fouling. FIG. 5 is a schematic representation of the heat exchange tube support plates 58 that employ one embodiment described herein for regulating the tube bundle or shell-side flow (recirculation fluid, feedwater and steam) up through the tube bundle to enhance the anti-clogging capability of the steam generator. The approach illustrated addresses the streaming affect that occurs at the hot leg periphery of the upper tube support plates 58 by providing "standard" loss coefficient tube support plate porosity in an annular ring 62 at the periphery of one or more of the upper most tube support plates. This approach is accomplished by employing the standard hole design that supports the heat exchange tubes in the annular ring 62 while employing a larger hole design in the remaining areas 60. With this approach, more flow is directed towards the center of the tube support plates that have the annular ring configuration 62, such that the velocities at the periphery of those support plates will be reduced. Since nonlinear dynamic models of the tube bundle indicate that the higher structural loads occur in the in-plane direction at the upper most tube support plates, integrity will be relatively unaffected with this hole pattern.

Figure 6:
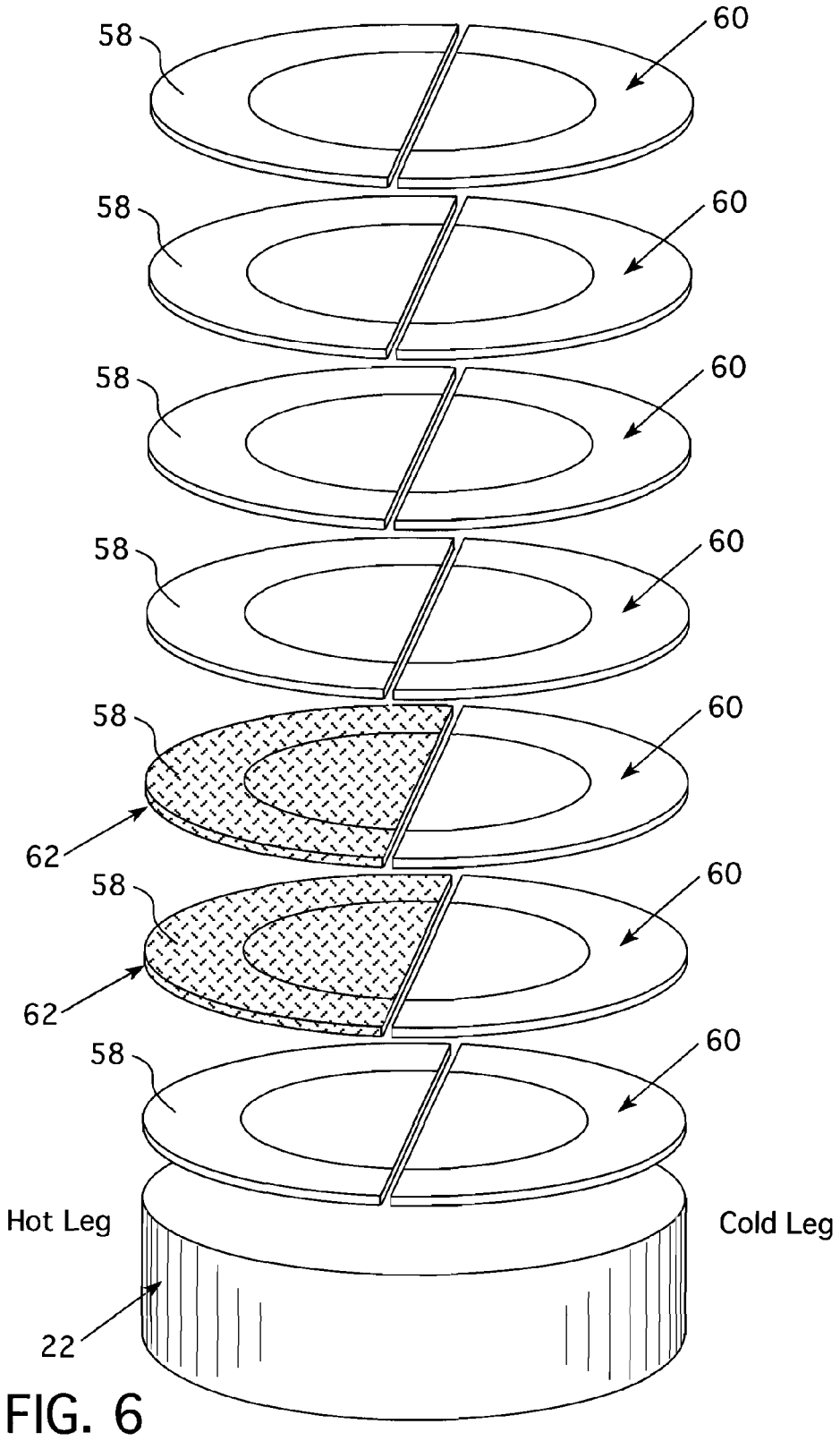
FIG. 6 is a schematic representation of the relative heat exchange tube hole pattern in the support plate of a tube and shell steam generator in accordance with a second embodiment of the invention described herein.

FIG. 6 shows a second embodiment for enhancing the anti-clogging capability of a steam generator. Similar to the strategy described with regard to FIG. 5, the embodiment shown in FIG. 6 places the higher resistance (i.e., higher K-factor) region of the tube support plates lower in the tube bundle to reduce velocities in the upper bundle region. The higher resistance portion of the tube support plates are shown in the darker areas 62 of plates 2 and 3 and direct more flow to the cold leg region, but are located in a region less prone to clogging than in the upper bundle region. In this embodiment, a "standard" K-factor is employed in the lighter areas 60 while the darker areas shown in the figure employ an "increased" K-factor region by using slightly smaller holes through which the heat exchange tubes pass.

It should be appreciated that the number of tube support plates may vary from generator to generator, depending on the size of the generator and its power output.

Figure 7A:
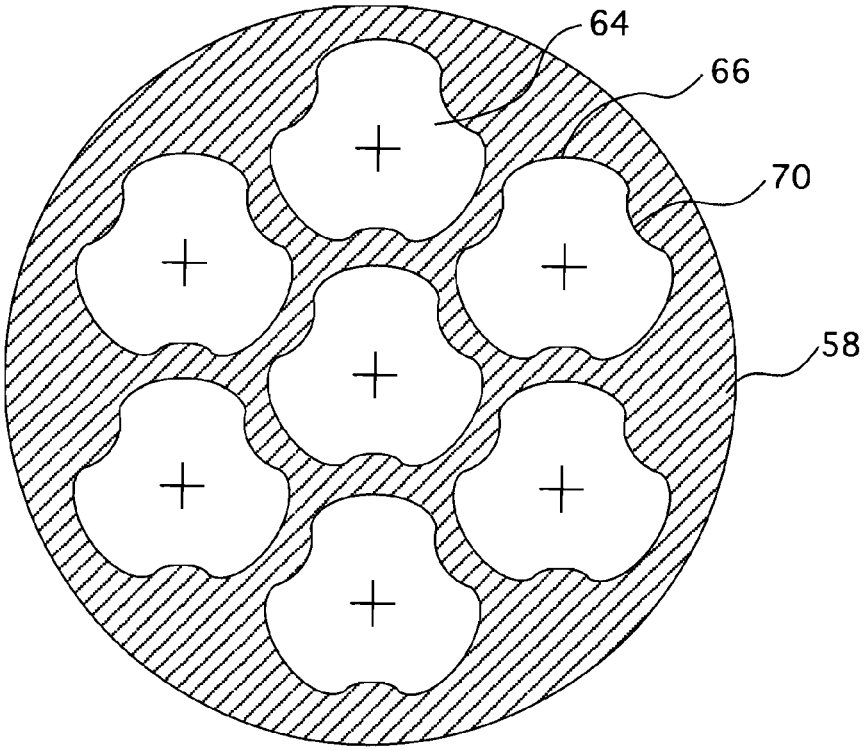
FIG. 7a Prior Art
FIG. 7A is a schematic plan view of a prior art tube support plate heat exchange tube hole pattern.
Figure 7B:
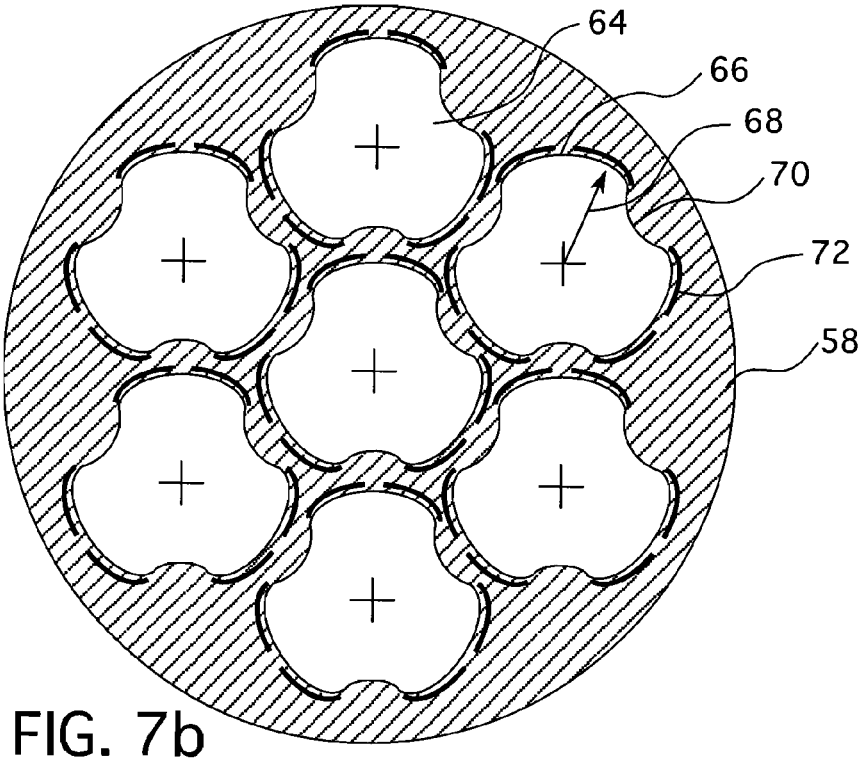
FIG. 7B shows the hole pattern illustrated in FIG. 7A as modified by one embodiment of this invention.

FIGS. 7A and 7B illustrate one way in which the K-factor in the tube support plates can be readily adjusted, by changing the radial distance from the center line to the lobes of the broached holes through which the heat exchange tubes pass. FIG. 7A schematically represents a tube support plate 58 in reduced form and illustrates one embodiment of a prior art tube support plate hole design 64 in which the heat exchange tubes are supported. The lands 70 support the tubes while the lobes 66 permit the tube bundle flow to pass upwardly through the support plates. FIG. 7B illustrates how the lobe radius 68 can be increased slightly at 72, or for that matter, decreased, to obtain the desired K-factor. Small changes in the lobe 66 size can have a significant effect on the plate loss coefficient.

Figure 8:
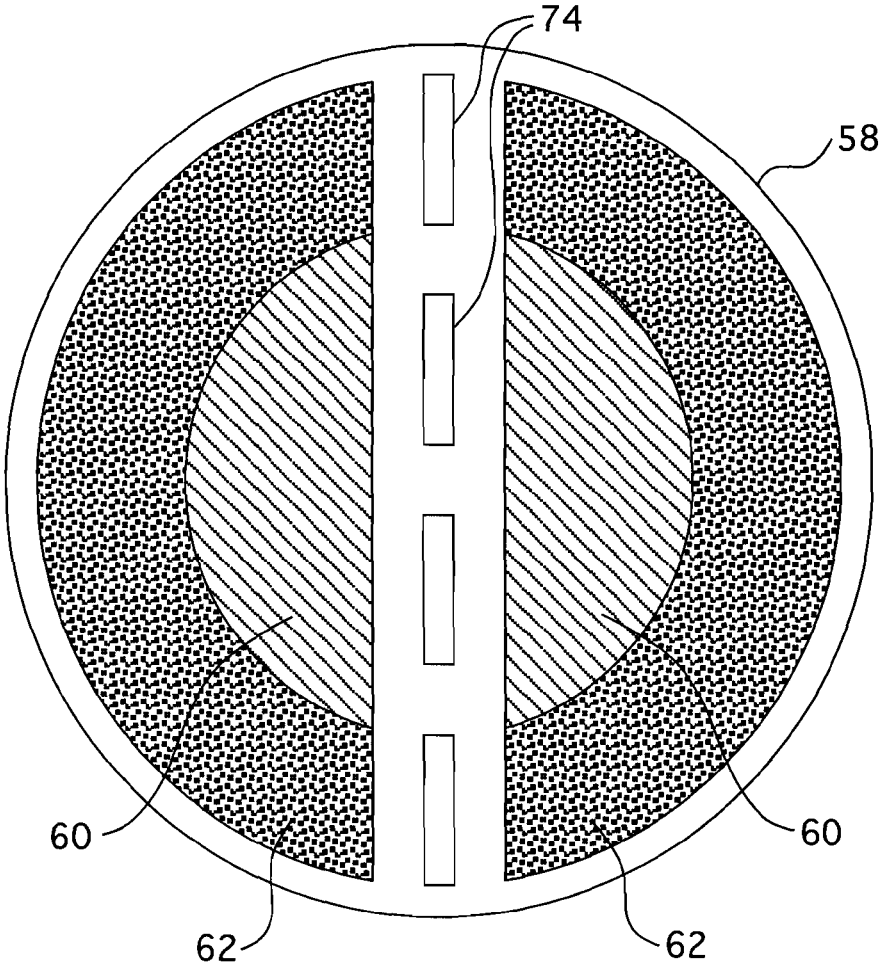
FIG. 8 is a plan view of a schematic graphical representation of another tube support plate hole pattern of another embodiment of the invention described herein.

Other approaches and arrangements of adjusting tube support plate K-factors both within individual tube support plates and amongst the vertical "stack" of tube support plates should be evident from the foregoing discussion, to optimize the anti-clogging capability of the tube bundle. For example, FIG. 8 shows the upper tube support plate design previously described with regard to FIG. 5 with additional flow slots or other openings 74 in the tube lane, which help further reduce the flow through the holes around the periphery of the tube support plate. Accordingly, while specific embodiments of the invention have been described in detail, it should be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A tube and shell steam generator comprising:

an elongated shell having an axis extending along the elongated dimension;

a tube sheet within the shell supported substantially transverse to the axis;

a plurality of heat exchange tubes extending axially from the tube sheet within the shell, with the plurality of heat exchange tubes forming a tube bundle in which a primary fluid passes within the heat exchange tubes and a secondary fluid passes around the outside of the heat exchange tubes; and a plurality of tandemly spaced tube support plates respectively positioned substantially transverse to the axis and extending substantially over a width of the tube bundle, with substantially each of the plurality of heat exchange tubes passing through a separate, corresponding tube support hole axially extending through at least some of the tube support plates, wherein the tube support plates are designed to pass the secondary fluid through the tube support holes in the tube support plates with a flow of the fluid regulated so the flow is larger through some of the tube support holes of the tube support plates than other of the tube support holes of the tube support plates.

2. The steam generator of Claim 1 wherein the flow of the secondary fluid through the tube support plates is regulated by varying the geometry of the tube support holes in the tube support plates.

3. The steam generator of claim 2 wherein some of the tube support holes in the tube support plates through which the plurality of heat exchange tubes respectively extend are larger than other of the tube support holes through which the plurality of heat exchange tubes respectively extend.

4. The steam generator of claim 3 wherein at least one of the uppermost tube support plates has the tube support holes around a periphery of the tube support plate through which the plurality of heat exchange tubes respectively extend that are smaller than the tube support holes through which the plurality of heat exchange tubes respectively extend, towards a center of the uppermost tube support plate.

5. The steam generator of claim 4 wherein at least one of the uppermost tube support plates comprises a plurality of uppermost tube support plates.

6. The steam generator of claim 3 wherein the tube support holes through which the plurality of heat exchange tubes respectively extend have a lobe on a periphery of the tube support holes and the larger tube support holes have a larger radius that extends from the centerline of the tube support holes to the lobe.

7. The steam generator of claim 3 wherein the plurality of heat exchange tubes respectively have a cold leg and a hot leg and at least some of the tube support holes in at least some of the tube support plates through which the hot legs pass are smaller than at least some of the tube support holes through which the cold legs pass.

8. The steam generator of claim 7 wherein the steam generator has a plurality of upper tube support plates and a plurality of lower tube support plates and wherein at least some of the tube support holes in at least some of the lower tube support plates through which the hot legs of the plurality of heat exchange tubes respectively pass are smaller than at least some of the corresponding tube support holes in at least some of the upper tube support plates.

9. The steam generator of claim 8 wherein the at least some of the tube support holes in at least some of the lower support plates through which the hot legs pass are smaller than at least some of the tube support holes through which at least some of the cold legs pass.

10. The steam generator of claim 9 wherein the at least some of the tube support holes in at least some of the lower support plates through which the hot legs pass are smaller than substantially all of the tube support holes through which the cold legs pass.

11. The steam generator of claim 1 wherein the plurality of heat exchange tubes are U-shaped tubes having a cold leg and a hot leg with the flow of fluid regulated by a porosity of the tube support plates so that the tube support plate porosity of most of the tube support holes through which the plurality of heat exchange tube cold legs respectively pass is larger than the tube support plate porosity of most of the tube support holes through which the plurality of heat exchange tubes hot legs respectively pass.

12. The steam generator of Claim 1 wherein the steam generator has a plurality of upper tube support plates and a plurality of lower tube support plates and a tube support plate porosity through a periphery of the upper tube support plates is less than the tube support plate porosity through a central portion of the same upper tube support plates.

13. The steam generator of claim 12 wherein the plurality of heat exchange tubes are U-shaped tubes respectively having a cold leg and a hot leg wherein the flow of the secondary fluid through the periphery of the upper tube support plates is regulated to be less than the flow of the secondary fluid through the central portion of the upper support plates.

14. The steam generator of claim 1 wherein the flow of the secondary fluid is at least partially regulated by a series of openings in a central tube lane in at least some of the tube support plates.

* * * * *